US008818245B2

(12) United States Patent
Takaya et al.

(10) Patent No.: US 8,818,245 B2
(45) Date of Patent: Aug. 26, 2014

(54) DEVELOPING DEVICE AND IMAGE FORMING APPARATUS

(75) Inventors: Shunichi Takaya, Hino (JP); Osamu Maeda, Sanda (JP)

(73) Assignee: Konica Minolta, Inc., Tokyo (JP)

( * ) Notice: Subject to any disclaimer, the term of this patent is extended or adjusted under 35 U.S.C. 154(b) by 343 days.

(21) Appl. No.: 13/051,746

(22) Filed: Mar. 18, 2011

(65) Prior Publication Data

US 2011/0229209 A1 Sep. 22, 2011

(30) Foreign Application Priority Data

Mar. 19, 2010 (JP) ..... 2010-064608

(51) Int. Cl.
*G03G 15/08* (2006.01)

(52) U.S. Cl.
CPC .... *G03G 15/0893* (2013.01); *G03G 2215/0827* (2013.01); *G03G 15/0844* (2013.01); *G03G 2215/0838* (2013.01); *G03G 2215/0607* (2013.01)
USPC ..... 399/257

(58) Field of Classification Search
USPC ..... 399/257, 260
See application file for complete search history.

(56) References Cited

U.S. PATENT DOCUMENTS 5,592,270 A * 1/1997 Takai et al. ..... 399/260
2008/0199205 A1 8/2008 Kubo et al.

FOREIGN PATENT DOCUMENTS

| | | | |
|---|---|---|---|
| JP | 2-21591 | | 5/1990 |
| JP | 2006-285024 | | 10/2006 |
| JP | 2006285024 | A * | 10/2006 |
| JP | 2008-233834 | | 10/2008 |
| JP | 2009031596 | A * | 2/2009 |
| JP | 2009-196470 | | 9/2009 |

OTHER PUBLICATIONS

JP 2006-285024 English translation Adachi Oct. 2006.*
JP 2009-031596 English translation, Uno et al., Feb. 2009.*
Notification of Reasons for Refusal mailed Feb. 7, 2012, directed to Japanese Patent Application No. 2010-064608; 6 pages.

* cited by examiner

*Primary Examiner* — David Gray
*Assistant Examiner* — Thomas Giampaolo, II
(74) *Attorney, Agent, or Firm* — Holtz Holtz Goodman & Chick PC

(57) ABSTRACT

A developing device having a housing that houses two-component developer containing carrier and toner, replenishing replenishment carrier to the housing while gradually ejecting developer to outside from an outlet. The developing device includes: transport passage provided in the housing so that developer is transported therein; transport member provided in the housing and rotates to transport the developer; ejection passage having diverged from the transport passage so that a part of the developer transported in the transport passage is conveyed therein to the outlet; and restriction unit configured to restrict an amount of ejected developer so that a first amount of developer is ejected from the outlet when the transport member rotates at a first speed, and a second amount of developer is ejected when it rotates at a second speed. The second amount is smaller than the first amount. The second speed is higher than the first speed.

10 Claims, 8 Drawing Sheets

(Comparative example 1)

(Comparative example 2)

DEVELOPING DEVICE AND IMAGE FORMING APPARATUS

This application is based on an application No. 2010-064608 filed in Japan, the contents of which are hereby incorporated by reference.

BACKGROUND OF THE INVENTION (1) Field of the Invention

The present invention relates to a developing device for developing an electrostatic latent image held by an image holder such as a photosensitive drum, by using developer, and to an image forming apparatus provided with the developing device.

(2) Related Art

Image forming apparatuses, such as copiers or printers, are provided with a developing unit which houses a developer containing carrier and toner and develops an electrostatic latent image held by a photosensitive drum.

As one example of the developing method, there is known a trickle developing method in which fresh replenishment carrier is gradually replenished into a housing provided in the developing unit from an inlet of the housing, the developer housed in the housing is cyclically transported within the housing by a transport screw, and while the cyclical transport is performed, an excessive amount of developer, which is generated by the replenishment of carrier, is ejected to outside from an outlet provided in the housing as it overflows.

In the trickle developing method, old carrier contained in the developer in the housing is gradually replaced with fresh carrier, substantially preventing deteriorated carrier from remaining in the housing. This restricts the deterioration of the developer and realizes the high-quality image.

One problem of the developing unit adopting the trickle developing method is that the amount of developer housed in the housing is apt to vary depending on the image formation conditions.

That is to say, since the developer is transported to the outlet by the transport force that is generated as the transport screw is rotated, the amount of ejected developer depends on the rotation speed of the transport screw. For example, when the transport screw rotates at a high speed, a large amount of developer is transported per unit time to the outlet, and a large amount of developer is ejected. Conversely, when the transport screw rotates at a low speed, a small amount of developer is ejected.

Copiers or the like having the developing unit are typically provided with various copy modes from which selection can be made, such as the color mode and the monochrome mode. Many of the various modes are set to different system speeds. For example, when the system speed in the color mode is set as the standard speed, the system speed in the monochrome mode is set to be higher than the standard speed, from the view point of the copying productivity.

The rotation members, such as the photosensitive drum provided in the copier and the transport screw provided in the developing unit, are typically controlled to rotate at a speed corresponding to the system speed in each mode. That is to say, when the system speed is changed, the rotation speed of the transport screw is changed as well.

For example, when the copy mode is switched from the color mode to the monochrome mode, the system speed is switched from a low speed to a high speed, and the transport screw is rotated at a high speed.

When the rotation speed of the transport screw is switched from low to high, the amount of developer transported by the transport screw per unit time increases, and the amount of developer ejected from the outlet increases. When the amount of developer ejected from the outlet increases, the total amount of developer in the housing decreases that much, namely, a variation occurs in the amount of developer.

When the total amount of developer in the housing decreases as the transport screw rotates at a high speed, the liquid surface of the developer is lowered. When this state continues, the shortage of developer supply occurs, and the image quality is apt to be deteriorated due to reduction in the concentration during the developing process.

There is the opposite case in which the rotation speed of the transport screw is switched from high to low. For example, when the mode is switched to the mode for using the thick paper when the regular paper has been set as the standard among various types of paper for use, the system speed is switched to a lower speed than the standard speed since the fixing process for thick paper requires a larger amount of heat than for regular paper.

In that case, the transport screw is rotated at a low speed, and the amount of developer transported by the transport screw per unit time and the amount of ejected developer are decreased compared to the state before the switching. When the amount of ejected developer is decreased, the total amount of developer in the housing is increased that much. When this state continues, the amount of developer in the housing is increased excessively, and the driving torque of the transport screw is increased, which imposes the load on the driving motor and may cause the transport screw to rotate unevenly or cause the developer to overflow from the housing.

SUMMARY OF THE INVENTION

It is therefore an object of the present invention to provide a developing device which, with the trickle developing method, can restrict the variation in the amount of developer to the minimum, and an image forming apparatus provided with the developing device.

The above object is fulfilled by a developing device having a housing that houses a two-component developer containing a carrier and a toner, replenishing a replenishment carrier to the housing while gradually ejecting the developer to outside from an outlet, the developing device comprising: a transport passage provided in the housing so that the developer is transported therein; a transport member provided in the housing and configured to rotate to transport the developer; an ejection passage having diverged from the transport passage so that a part of the developer transported in the transport passage is conveyed therein to the outlet; and a restriction unit configured to restrict an amount of ejected developer so that a first amount of developer is ejected from the outlet when the transport member rotates at a first speed, and a second amount of developer is ejected from the outlet when the transport member rotates at a second speed, the second amount being smaller than the first amount, the second speed being higher than the first speed.

The above object is also fulfilled by an image forming apparatus comprising a developing device for developing an electrostatic latent image held by an image holder by using a developer, the developing device having a housing that houses a two-component developer containing a carrier and a toner, replenishing a replenishment carrier to the housing while gradually ejecting the developer to outside from an outlet, the developing device including: a transport passage provided in the housing so that the developer is transported therein; a transport member provided in the housing and configured to rotate to transport the developer; an ejection passage having diverged from the transport passage so that a part of the developer transported in the transport passage is conveyed therein to the outlet; and a restriction unit configured to restrict an amount of ejected developer so that a first amount of developer is ejected from the outlet when the transport member rotates at a first speed, and a second amount of developer is ejected from the outlet when the transport member rotates at a second speed, the second amount being smaller than the first amount, the second speed being higher than the first speed.

The above object is further fulfilled by an image forming apparatus comprising: a developing device; a driver configured to drive a transport member included in the developing device; and a controller configured to control the driver to stop the transport member from rotating, to be in a state in which an outlet of an ejection passage in the developing device is closed by a shutter provided in the developing device, wherein the developing device has a housing that houses a two-component developer containing a carrier and a toner, replenishes a replenishment carrier to the housing while gradually ejecting the developer to outside from the outlet, the developing device including: a transport passage provided in the housing so that the developer is transported therein; the transport member provided in the housing and configured to rotate to transport the developer; the ejection passage having diverged from the transport passage so that a part of the developer transported in the transport passage is conveyed therein to the outlet; and a restriction unit configured to restrict an amount of ejected developer so that a first amount of developer is ejected from the outlet when the transport member rotates at a first speed, and a second amount of developer is ejected from the outlet when the transport member rotates at a second speed, the second amount being smaller than the first amount, the second speed being higher than the first speed, wherein the restriction unit includes: a shutter configured to move and close the outlet by covering thereof; and a moving mechanism configured to move the shutter so that the outlet is opened for a first time period per rotation of the transport member when the transport member rotates at the first speed, and the outlet is opened for a second time period per rotation of the transport member when the transport member rotates at the second speed, the second time period being shorter than the first time period, wherein the ejection passage is composed of a first cylindrical member, the outlet is provided in a circumferential surface of the first cylindrical member, the shutter is composed of a second cylindrical member whose circumferential surface has a hole, and the shutter is fixed on the first cylindrical member to be rotatable in a circumferential direction relative to the first cylindrical member, is disposed at a position where at least part of the hole overlaps with the outlet in an axis direction of the first cylindrical member, and closes the outlet when the shutter is, by rotation, at a position where the hole does not overlap with the outlet, and the moving mechanism causes the shutter to rotate in a same direction as a rotation of the transport member in coordination with the transport member.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF PREFERRED EMBODIMENTS

The following describes an embodiment of the image forming apparatus of the present invention, taking a tandem color digital printer (hereinafter, merely referred to as a printer) as an example.

<Overall Structure of Printer>

Figure 1:
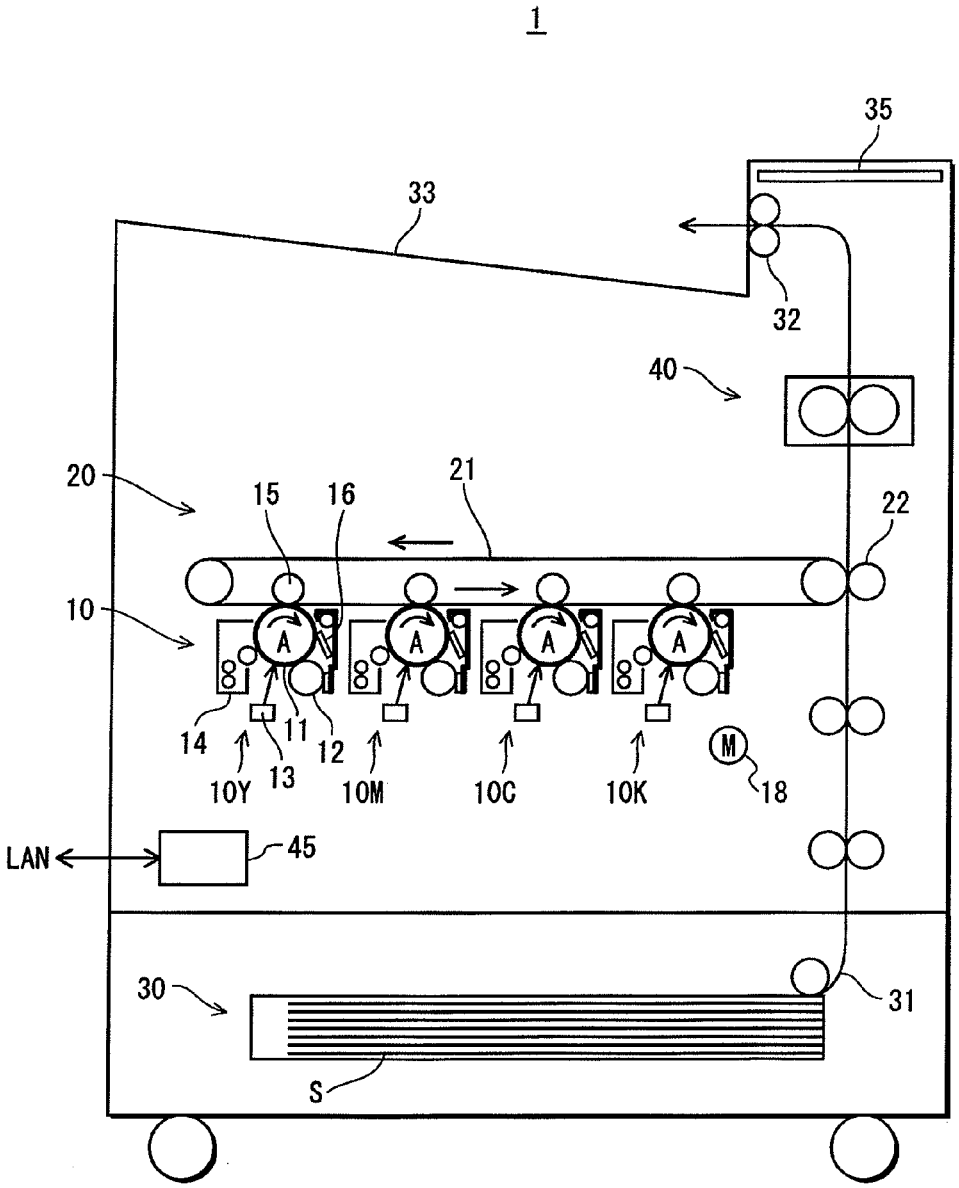
FIG. 1 shows an overall structure of the printer in the embodiment.

FIG. 1 shows an overall structure of a printer 1 in the present embodiment.

As shown in FIG. 1, the printer 1 is structured to form an image by a well-known electrophotographic method, and includes an image processing unit 10, an intermediate transfer unit 20, a feeding unit 30, a fixing unit 40, and a control unit 45. Upon receiving a request to execute a job from an external terminal device (not illustrated) via a network (in this example, a LAN), the printer 1 can selectively execute a color or monochrome print according to the received job request.

The image processing unit 10 includes image creating units 10Y, 10M, 10C, and 10K corresponding respectively to colors of yellow (Y), magenta (M), cyan (C), and black (K). The image creating unit 10Y includes a photosensitive drum 11, and also a charger 12, an exposing unit 13, a developing unit 14, a first transfer roller 15, and a cleaner 16, which are arranged in the circumference of the photosensitive drum 11.

The charger 12 electrically charges the circumferential surface of the photosensitive drum 11 which rotates in the direction indicated by the arrow A.

The exposing unit 13 forms an electrostatic latent image on the photosensitive drum 11 by emitting a laser beam to expose-scan the charged photosensitive drum 11.

The developing unit 14, using the trickle developing method, is provided with a two-component developer containing carrier and toner, and develops the electrostatic latent image on the photosensitive drum 11 by the toner. This allows a yellow (color Y) toner image to be formed on the photosensitive drum 11.

The first transfer roller 15 causes the yellow toner image to be transferred from the photosensitive drum 11 onto the intermediate transfer belt 21 by the electrostatic action. The cleaner 16 cleans the toner that has remained on the photosensitive drum 11Y after the transfer. Each of the other image creating units 10M through 10K has the same structure as the image creating unit 10Y, and reference signs of the components thereof are omitted in FIG. 1.

In the present embodiment, almost all the parts of each of the image creating units 10M through 10K except for the first transfer roller 15 are formed as one unit, and can be attached to or detached from the device in unit of an image creating unit. The users can replace an old image creating unit with a new image creating unit.

The intermediate transfer unit 20 is provided with the intermediate transfer belt 21 that is suspended with tension between a drive roller and a passive roller, and is caused to move cyclically in the direction indicated by the arrows shown in FIG. 1.

To execute a color print (a print in the color mode), toner images of colors respectively corresponding to the image creating units 10Y through 10K are created on the photosensitive drum 11, and the created toner images are transferred onto the intermediate transfer belt 21. In this image creation of colors Y through K, the toner images of these colors are transferred at timings that are shifted in order from the upstream side to the downstream side so that they are layered on the intermediate transfer belt 21 at the same position.

The feeding unit 30 feeds sheets S one by one from the paper feed cassette at timings corresponding to the image creations so that the sheets S are transported in the transport path 31 to the second transfer roller 22.

The toner images of respective colors formed on the intermediate transfer belt 21 are transferred onto a sheet S at the same time by the electrostatic action of the second transfer roller 22 as the second transfer when the sheet S passes through between the second transfer roller 22 and the intermediate transfer belt 21.

The sheet S on which the toner images of the respective colors have been transferred by the second transfer is transported to the fixing unit 40, in which it is heated and receives a pressure, thereby the toner on the surface of the sheet S melts to be fixed to the surface, and then the sheet S is ejected onto a tray 33 by a paper ejecting roller 32.

Up to now, the operation in the color mode has been explained. When a print in a single color such as black (a print in the monochrome mode) is executed, only the image creating unit 10K for black is driven, and the same operation as described above is performed so that a black image is formed (printed) on a sheet S through the steps of charging, exposing, developing, transferring, and fixing. Note that in the monochrome mode, one color other than black may be used.

In the present embodiment, the system speed (the rotation speed of each rotation member such as the photosensitive drum 11 and the transport screw of the developing unit 14) can be varied to be different in the color mode and the monochrome mode. In the present example, the system speed can be varied to be low in the color mode and high in the monochrome mode. The reason that the system speed is made low in the color mode is to give preference to the image quality of the color image to be formed; and the reason that the system speed is made high in the monochrome mode is to give preference to the productivity because there is no fear that a color deviation occurs when the single color is used.

Rotation members such as the photosensitive drum 11 are driven by a driving motor 18 to rotate. The driving motor 18 is configured so that the rotation speed thereof can be switched between low and high depending on the mode. The switching is controlled by the control unit 45.

An operation panel 35 is arranged at a position which facilitates the operation of the user, a position on the front and upper surface of the device (printer 1). The operation panel 35 is provided with buttons for receiving a selection by the user of a mode (the color mode or the monochrome mode), a touch-panel-type liquid-crystal display or the like, and conveys various types of information such as information of the mode selected by the user, to the control unit 45.

The control unit 45 controls the constitutional elements of the device based on the print job data received from an external terminal device via the network, to perform the print smoothly. In this control, the control unit 45 receives information of the selection of a mode from the operation panel 35, and when the color or monochrome mode has been selected by the user, it executes the print in the selected mode.

Note that the present invention is not limited to the structure in which a selection of a mode is received from the operation panel 35, but the print job data received from an external terminal device may contain information specifying the mode to be executed, and the mode to be executed may be determined by reading the information from the received print job data.

<Structure of Developing Unit>

Figure 2:
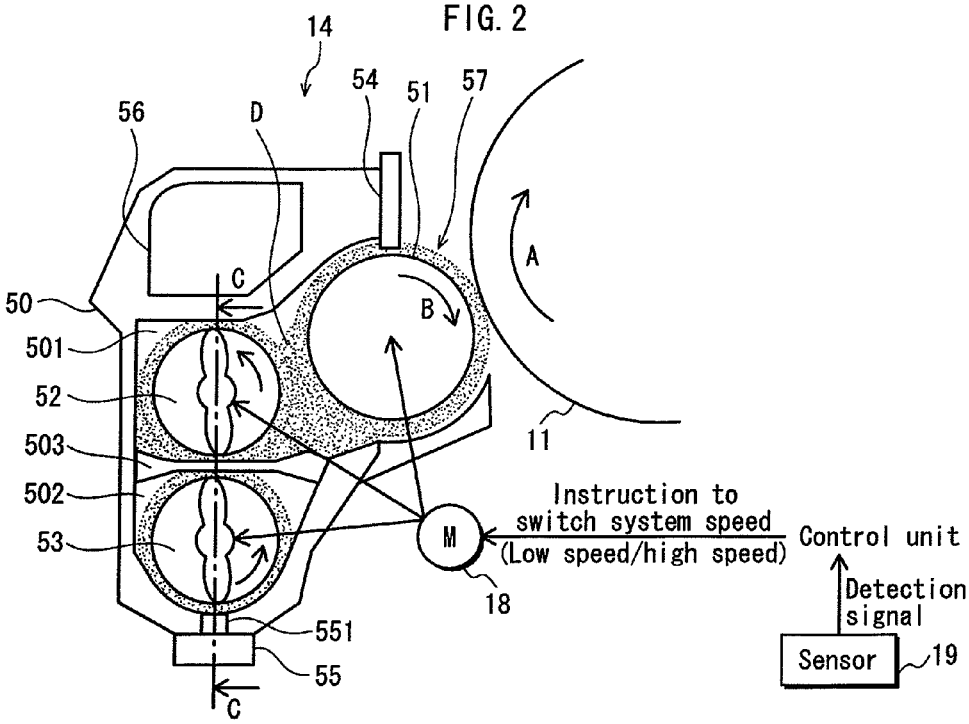
FIG. 2 is a transverse sectional view showing an example of the structure of the developing unit provided in the printer.

FIG. 2 is a transverse sectional view showing an example of the structure of the developing unit 14.

As shown in FIG. 2, the developing unit 14 includes a developing housing 50, a developing roller 51, a transport screw 52, a stirring screw 53, an amount control member 54, a toner concentration detecting sensor 55, and a replenishing unit 56.

The developing housing 50 is longitudinal along the direction of the axis of the developing roller 51 (the direction perpendicular to the sheet: hereinafter referred to as "axis direction"), houses therein, as a developer D, a two-component developer containing carrier and toner, and is separated by a partition wall 503 into a developing chamber 501 (an upper part) and a stirring chamber 502 (a lower part).

The developing chamber 501 and the stirring chamber 502 are structured such that the developing chamber 501 and the stirring chamber 502 communicate with each other at one end in the axis direction (hereinafter referred to as "device front side") via a first communication passage and the developing chamber 501 and the stirring chamber 502 communicate with each other at the other end in the axis direction (hereinafter referred to as "device back side") via a second communication passage, these constituting a cyclical transport passage for cyclically transporting the developer D housed in the developing housing 50.

The developing roller 51 is supported in an opening 57 of the developing chamber 501 to be rotatable in the direction indicated by the arrow B, the opening 57 being provided at a position facing the photosensitive drum 11. The developing roller 51 holds the developer D on the surface thereof and carries the developer D to a developing position (developing nip) facing the photosensitive drum 11.

The transport screw 52, disposed in the developing chamber 501 at a position facing the photosensitive drum 11 across the developing roller 51, and rotatably supported in parallel with the axis direction, transports the developer D housed in the developing chamber 501 from the device front side to the device back side along the axis direction, and supplies the developer D to the developing roller 51 while transporting the developer D. The developer D transported in the developing chamber 501 to the device back side by the transport screw 52 passes through the second communication passage and goes into the stirring chamber 502 located under the developing chamber 501.

The stirring screw 53, provided in the stirring chamber 502 and rotatably supported in parallel with the axis direction, transports the developer D, which has been sent via the second communication passage from the developing chamber 501, in a direction the reverse of the transport by the transport screw 52, namely toward the device front side, while stirring the developer D to prevent from hardening and keep the fluidity thereof in the stirring chamber 502.

The developer D having been transported to the device front side by the stirring screw 53 passes through the first communication passage and goes into the developing chamber 501 located on the stirring chamber 502, and then is transported toward the device back side again by the transport screw 52 provided in the developing chamber 501. The developing roller 51, transport screw 52 and stirring screw 53 are driven by the driving force of the driving motor 18 to rotate in the respective directions indicated by the arrows shown in FIG. 2, and the rotation speeds thereof are varied to be low in the color mode and high in the monochrome mode. Note that the developing roller 51, transport screw 52 and the like may be driven independently by a plurality of corresponding motors to rotate, not by one motor, the driving motor 18.

The amount control member 54, disposed so that the end tip thereof is a predetermined distance away from the surface of the developing roller 51, making a gap therebetween, controls the amount of developer on the surface of the developing roller 51 that passes through the gap so that an appropriate amount of developer is provided at the developing position while the developing roller 51 moves.

The toner concentration detecting sensor 55 is a sensor for detecting the concentration of the developer D. A detecting unit 551 provided in the toner concentration detecting sensor 55 is extended into the developing housing 50 via a hole provided in the developing housing 50. The toner concentration detecting sensor 55, by using the detecting unit 551, detects a ratio of the toner and the carrier in the developer D housed in the developing housing 50, and outputs a detection signal indicating the detected ratio to the control unit 45.

The replenishing unit 56 is provided with a developer container and a toner container, wherein the developer container contains developer for replenishment including at least the carrier, and the toner container contains toner for replenishment. The replenishing unit 56 replenishes the developing housing 50, the stirring chamber 502 in the present example, with the developer for replenishment and the toner for replenishment separately.

More specifically, with regard to the developer for replenishment, the replenishing unit 56 replenishes a predetermined amount of the developer for replenishment at regular intervals (for example, every several seconds) while the developing roller 51, transport screw 52 and stirring screw 53 are rotating. With the replenishment of the developer, the amount of the developer D in the developing housing 50 increases. However, in the trickle developing method, developer substantially equivalent with the replenished developer in amount is ejected to outside from an outlet 62 (see FIG. 7), and thus the amount of the developer D does not continue to increase, but is maintained to be constant.

The toner for replenishment is replenished in accordance with an instruction from the control unit 45. More specifically, when the toner concentration detecting sensor 55 detects a ratio of the toner and the carrier while the developing roller 51, transport screw 52 and the like rotate in the image formation operation or the like, and when the control unit 45 judges from the detected ratio that the amount of toner is small, the control unit 45 instructs the replenishing unit 56 to replenish the toner so that the ratio becomes a predetermined ratio. Upon receiving the instruction from the control unit 45, the replenishing unit 56 replenishes an instructed amount of toner. Note that the above replenishment control method is merely one example, and, not limited to this, another replenishment control method may be used as far as it can realize the trickle developing method.

Note that, as shown in FIG. 2, the control unit 45 has a function to receive the detection signal from a position detection sensor 19 and control the stop position of the transport screw 52 in the rotation direction. This control will be described later.

Figure 3:
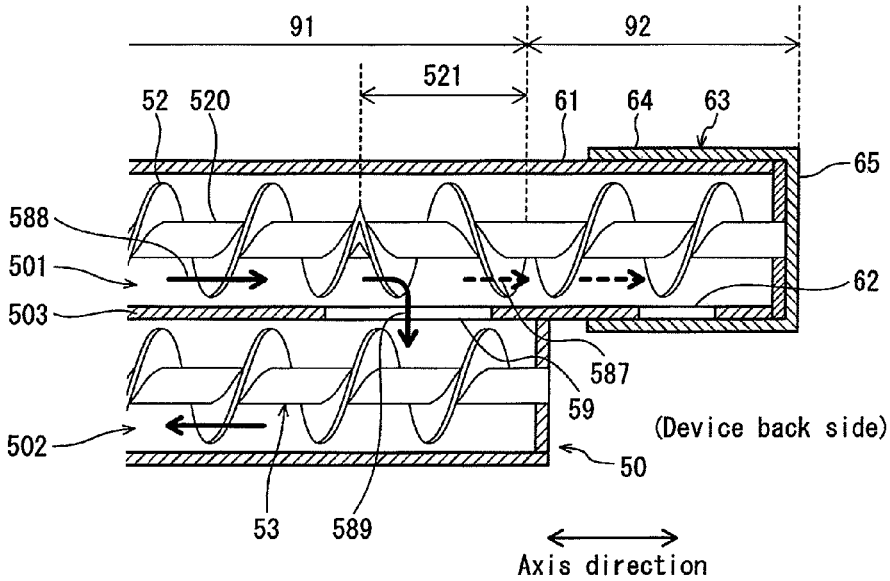
FIG. 3 is a cross sectional view of the developing unit taken along the line C-C of FIG. 2.

FIG. 3 is a cross sectional view of the developing unit 14 taken along the line C-C of FIG. 2, showing only the end of the developing housing 50 on the device back side.

As shown in FIG. 3, the developing chamber 501 is longer than the stirring chamber 502 in the axis direction, extending toward the device back side further than the stirring chamber 502. A part 91 of the developing chamber 501 having the same length as the stirring chamber 502 corresponds to a passage in which the developer D is transported (hereinafter the part 91 is referred to as "transport passage 91"), and a part 92 extending further than the stirring chamber 502 corresponds to a passage in which the developer D is ejected (hereinafter the part 92 is referred to as "ejection passage 92").

The partition wall 503 provided between the developing chamber 501 and the stirring chamber 502 has a communication hole 59 so that the developing chamber 501 and the stirring chamber 502 are communicated with each other on the device back side. The communication hole 59 corresponds to the second communication passage described above.

The transport passage 91 is provided so that the developing chamber 501 continues to the stirring chamber 502 via the communication hole 59. The transport passage 91 is composed of a straight passage 588 and a curved passage 589, wherein the straight passage 588 is a passage in which the developer D is transported by the transport screw 52 to the communication hole 59 in the developing chamber 501, and the curved passage 589 is a passage which is curved at the communication hole 59 toward the stirring chamber 502 and in which the developer D is transported toward the stirring chamber 502.

The ejection passage 92 is a passage which diverges from the transport passage 91. The ejection passage 92 includes a straight passage 587 which is an extension of the straight passage 588. The curved passage 589 corresponds to one of two passages into which the straight passage 588 diverges at a downstream end in the developer D transport direction. The other of the two diverged passages is the straight passage 587 which corresponds to the extension of the straight passage 588 in the developer D transport direction.

The transport screw 52 provided in the developing chamber 501 has a spiral vane wound around a rotation shaft 520 and extends from an end on the device front side to an end on the device back side of the developing chamber 501, and is inserted in the straight passage 588 and the straight passage 587.

The spiral vane of the transport screw 52 is formed to transport the developer contained in the developing chamber 501 from the device front side to the device back side (to the right-hand side of FIG. 3), except for a part 521 facing the communication hole 59, the part 521 being formed to transport the developer in the reverse direction, namely from the device back side to the device front side (to the left-hand side of FIG. 3). Hereinafter, the part 521 of the spiral vane is referred to as "reverse winding part 521".

The reverse winding part 521 is provided for the following reasons. That is to say, when the rotation speed of the transport screw 52 is changed from low to high, the amount of transport per unit time increases. This increases the amount of developer sent from the transport passage 91 to the ejection passage 92, and too much amount of developer may be ejected to outside. The reverse winding part 521 is provided to prevent the ejection of too much amount of developer to outside.

A housing part 61 of the developing chamber 501 that constitutes the ejection passage 92 has a cylindrical shape that is circular in the cross sectional view, and the housing part 61 is provided with an outlet 62, a hole, at the lowest part of the circumference thereof. A cylindrical shutter 63 is fit onto the housing part 61 to open and close the outlet 62 of the housing part 61.

<Structure of Shutter>

Figure 4:
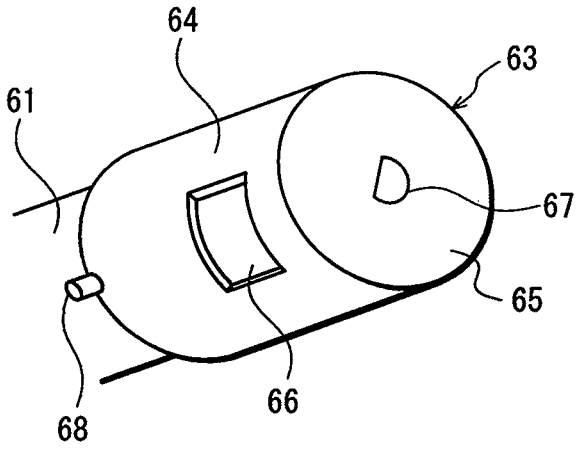
FIG. 4 is a perspective view of the outer appearance of the shutter provided in the developing unit.
Figure 5:
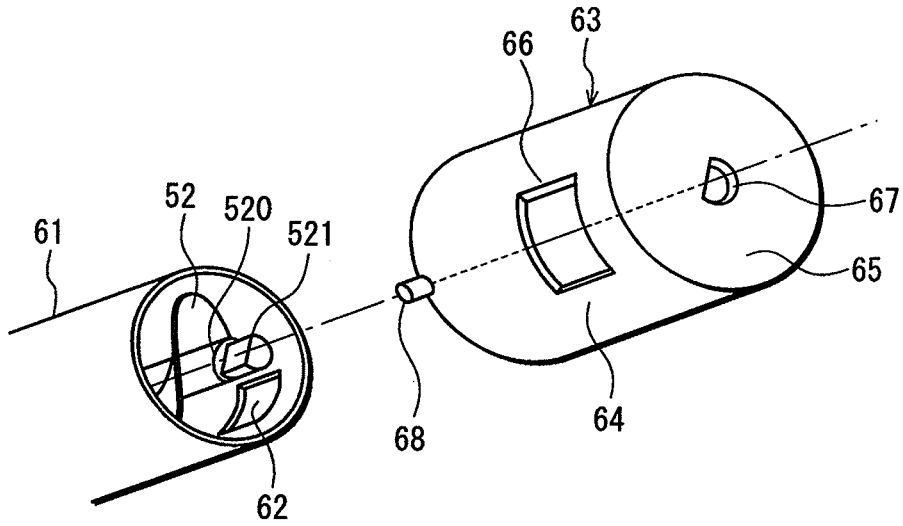
FIG. 5 is an exploded perspective view of the shutter.

FIG. 4 is a perspective view of the outer appearance of the shutter 63. FIG. 5 is an exploded perspective view of the shutter 63.

As shown in FIGS. 4 and 5, the shutter 63 is a cylinder-with-a-bottom member including a cylindrical part 64 and a bottom part 65 that seals one end of the cylindrical part 64. A hole 66 is provided in the circumferential surface of the cylindrical part 64. The hole 66 is substantially the same as the outlet 62 provided in the housing part 61 in size.

The inner diameter of the cylindrical part 64 is substantially the same as the outer diameter of the housing part 61. The shutter 63 is supported by the housing part 61 so that the shutter 63 is rotatable around the rotation shaft 520 in the state where the inner surface of the cylindrical part 64 is substantially in contact with the outer surface of the housing part 61.

A hole 67 in the shape of character "D" is provided in the rotational center of the bottom part 65 of the shutter 63. Also, an end of the rotation shaft 520 of the transport screw 52 has a part 521 whose cross-sectional shape is substantially the same as the character "D" shape of the hole 67. The shutter 63 is interlocked with the transport screw 52 when the part 521 of the rotation shaft 520 with the cross-sectional shape of character "D" is fit into the hole 67 of the bottom part 65.

When the transport screw 52 rotates, the rotational driving force thereof is conveyed to the shutter 63 via the rotation shaft 520, and the shutter 63 rotates around the housing part 61 together with the transport screw 52 in the same direction. The structure in which the rotational driving force for rotating the shutter 63 is given from the transport screw 52 eliminates the need to have other rotational driving mechanisms, resulting in the simplification of the structure.

The hole 66 provided in the circumferential surface of the cylindrical part 64 is substantially at the same position in the axis direction as the outlet 62 provided in the housing part 61. Accordingly, during one rotation of the shutter 63 around the housing part 61, two states are created: the open state in which the hole 66 of the shutter 63 overlaps with the outlet 62 of the housing part 61; and the closed state in which the hole 66 does not overlap with the outlet 62.

When a state, in which the hole 66 of the shutter 63 overlaps with at least part of the outlet 62 of the housing part 61, is created as the shutter 63 is rotated, the ejection passage 92 is communicated with the outside of the developing housing 50 via the outlet 62 and the hole 66, which is the state in which the outlet 62 is opened. Conversely, in the state in which the hole 66 and the outlet 62 do not overlap with each other, the circumferential surface of the cylindrical part 64 of the shutter 63 functions as a lid of the outlet 62, which is the state in which the outlet 62 is closed.

The circumferential outer surface of the shutter 63 is provided with a projection 68. The projection 68 is a member that is used to determine a position at which the hole 66 of the shutter 63 and the outlet 62 do not overlap with each other when the rotation of the transport screw 52 stops. In the present example, the position is the stopping position of the shutter 63 in the rotation direction with which the hole 66 is at the highest position.

It is structured that when the hole 66 is at the highest position, the projection 68 is also at the highest position, only when the projection 68 is detected by the position detection sensor 19.

When the position detection sensor 19 detects the projection 68, the detection signal indicating the detection is sent to the control unit 45. The control unit 45 performs a driving control of the driving motor 18 based on the detection signal received from the position detection sensor 19 to stop the rotation of the transport screw 52.

Figure 6:
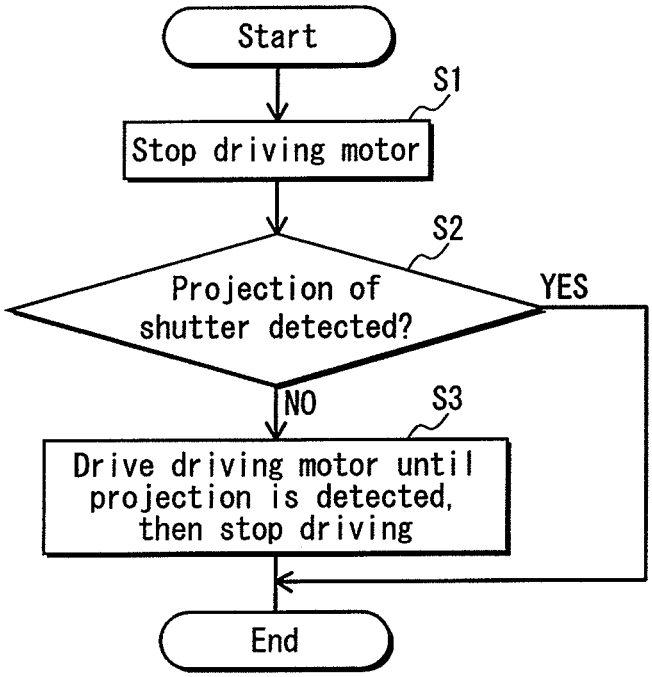
FIG. 6 is a flowchart of the driving control.

FIG. 6 is a flowchart of the driving control. The driving control is performed when the condition for stopping the rotation of the transport screw 52 is satisfied. The condition is determined in advance. The condition is, for example, the stop of the developing operation or the stop of the print.

In step S1, the driving motor 18 is stopped.

In step S2, it is judged whether or not the projection 68 of the shutter 63 has been detected by the position detection sensor 19. When it is judged that the projection 68 of the shutter 63 has been detected by the position detection sensor 19 ("YES" in step S2), the control is ended.

When it is judged that the projection 68 has not been detected ("NO" in step S2), the driving motor 18 is driven again until it is judged that the projection 68 has been detected, and then the driving is stopped (step S3), and the control is ended. The rotation speed of the driving motor 18 in this operation is desirably low so that the driving can be stopped while the projection 68 of the shutter 63 is within the detection position of the position detection sensor 19.

With this structure, the transport screw 52 is stopped in the state in which the hole 66 and the outlet 62 do not overlap with each other, namely, in the state in which the outlet 62 is closed by the shutter 63.

In this way, the driving motor 18 is controlled so that the device is in the state in which the outlet 62 is closed by the shutter 63. This makes it possible to prevent the developer D from leaking from the developing housing 50 through the outlet 62 when the user changes the image creating units.

Note that, not limited to the above driving control method, other driving control methods may be used. That is to say, any driving control method can be used as far as it enables the rotation of the transport screw 52 to be stopped in the state in which the outlet 62 is closed by the shutter 63.

As an example of another structure, the projection 68 may be detected only when the hole 66 of the shutter 63 overlaps with the outlet 62; if the projection 68 has not been detected when the transport screw 52 is stopped, the transport screw 52 is kept stopped; and if the projection 68 has been detected, the driving motor 18 is controlled to rotate as much as the transport screw 52 rotates approximately by half to shift the hole 66 away from the outlet 62.

As the position detection sensor 19, for example, a reflective photosensor including a light-emitting unit and a light-receiving unit may be used. In this structure, the light-emitting unit emits light to the projection 68, and the light-receiving unit receives the light that reflects off the projection 68 and returns. Note that, not limited to the reflective photosensor, another type of sensor or a switch may be used as the detector, as far as it can detect the projection 68. Also, not limited to the structure using the projection 68, another structure may be used as far as it can detect the state in which the outlet 62 is closed by the shutter 63.

Furthermore, as far as the developer D can be ejected, the shutter 63 may be at any position where at least part of the hole 66 overlaps with the outlet 62 in the axis direction. Also, the hole 66 and the outlet 62 may not necessarily be the same in size.

Figure 7:
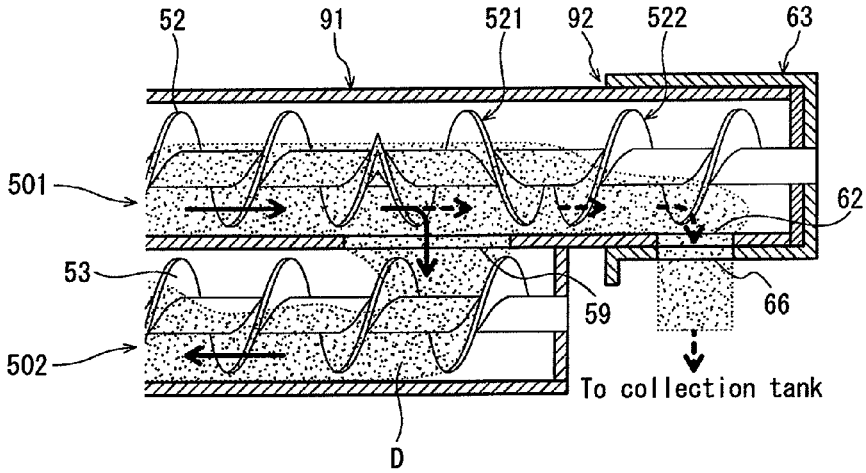
FIG. 7 illustrates how the developer is transported in the end of the developing housing on the device back side.

FIG. 7 illustrates how the developer D is transported in the end of the developing housing 50 on the device back side, wherein the hole 66 of the shutter 63 overlaps with the outlet 62 of the ejection passage 92 and the outlet 62 is opened.

As shown in FIG. 7, the developer D housed in the developing chamber 501 is transported in the transport passage 91 to the right-hand side of FIG. 7 when the transport screw 52 rotates. The developer D transported in the transport passage 91 receives a reverse transport force at the reverse winding part 521 of the transport screw 52. This restricts the amount of developer D that is transported in the transport passage 91 and enters the ejection passage 92, causing most of the developer D to drop into the stirring chamber 502 via the communication hole 59. The developer D that dropped into the stirring chamber 502 is transported in the stirring chamber 502 to the left-hand side of FIG. 7 (in the direction from the device back side to the device front side) when the stirring screw 53 provided therein rotates.

A part of the developer D that passes through the reverse winding part 521 of the transport screw 52 and enters the ejection passage 92 is transported in the ejection passage 92 to the right-hand side of FIG. 7 toward the outlet 62 when a forward winding part 522 rotates. When the outlet 62 is opened as shown in FIG. 7, the developer D having been transported to the outlet 62 is ejected to outside of the developing unit 14 via the outlet 62 and collected in a collection tank (not illustrated) provided outside. When the outlet 62 is closed by the shutter 63, the developer D is not ejected to outside, and temporarily remains in the ejection passage 92.

The outlet 62 is opened for a time period while the shutter 63 rotates once, the time period being determined in accordance with the rotation speed of the shutter 63. Accordingly, the time period during which the outlet 62 is opened depends on the rotation speed of the transport screw 52 which is equivalent with the rotation speed of the shutter 63. The rotation speed of the transport screw 52 is switched between low and high in accordance with the switch between the respective system speeds for the color mode and the monochrome mode.

When the rotation speed of the transport screw 52 is switched from low to high, the amount of developer D transported per unit time is increased as much as the speed is increased.

For example, when the low rotation speed of the transport screw 52 is represented as "A", and the high rotation speed "2×A", the amount of developer D transported per unit time is represented as "B" when the speed is low, and "2×B" when the speed is high.

When the size of the outlet 62 is large enough to eject 2×B of developer that is the amount of developer transported per unit time, the amount of developer ejected per unit time is "B" when the speed is low, and "2×B" when the speed is high, and in calculation, "2×B" should be twice "B" in proportion to the rotation speeds.

However, in a structure as the structure of the present embodiment in which the opening and closing of the outlet 62 are repeated as the shutter 63 rotates, the amount of ejection at the high speed is not twice the amount of ejection at the low speed, and is less than the double amount to some extent. The reason for this is as follows.

That is to say, when the rotation speed of the transport screw 52 is switched from low to high, the outlet 62 is opened for a shorter time period per rotation of the transport screw 52 than when the speed is low.

This means that the speed at which the hole 66 of the shutter 63 passes the outlet 62 becomes higher, and the time required for the hole 66 to pass the outlet 62 becomes shorter. More specifically, this means that the time required for the outlet 62 to be closed entirely again after being opened, during which the outlet 62 is gradually opened increasing the opening area until it is entirely opened, and then is gradually closed decreasing the opening area until it is entirely closed, becomes shorter.

The developer D having been ejected from the outlet 62 is composed of particles of carrier and toner and the like. When the outlet 62 is closed, the developer D remains on the outlet 62 and in the vicinity thereof, and is condensed to some extent. When the outlet 62 starts being opened in this state, the following phenomenon is apt to occur. That is to say, the condensed part of the developer D collapses, and the particles of carrier and toner drop by the force of gravity, pass through the outlet 62, and are ejected to outside.

When the time period of one opening of the outlet 62 is long, a much amount of the developer D that has remained on the outlet 62 and in the vicinity thereof is ejected from the outlet 62, by the flow of the developer D which starts as the outlet 62 starts being opened. However, when the time period of one opening of the outlet 62 is short, an amount of the developer D, which would have passed through the outlet 62 if the time period of one opening of the outlet 62 were longer, is apt to remain in the ejection passage 92 without being ejected since the outlet 62 is closed immediately before the amount of the developer D drops into the outlet 62. The amount of developer that "remains" corresponds to the above-mentioned amount of ejected developer to some extent by which the amount of ejection at the high speed is "less than" the amount of ejection at the low speed.

As in the above example, when the high rotation speed of the shutter 63 is twice the low rotation speed thereof, and the time period during which the outlet 62 is opened while the shutter 63 rotates once is represented as "X" when the rotation speed is low, the time period during which the outlet 62 is opened is represented as "X/2" when the rotation speed is high. The total opening time period per unit time is the same regardless of whether the rotation speed is low or high.

This means that, only with regard to the opening time period, the structure of the present embodiment functions in the same manner as the conventional structure in which the outlet is always opened.

In calculation, in the conventional structure where the outlet is always opened, when the total opening time period is the same regardless of whether the rotation speed is low or high, and the amount of the developer D transported per unit time in the high rotation speed of the screw 52 is twice the amount of the developer D transported per unit time in the low rotation speed of the screw 52, the amount of the developer D ejected per unit time in the high rotation speed should be twice the amount of the developer D ejected per unit time in the low rotation speed. However, in the structure having the shutter 63 of the present embodiment, the amount of the developer D ejected per unit time in the high rotation speed is less than twice the amount of the developer D ejected per unit time in the low rotation speed, by as much amount as remains without passing through the outlet 62 when the outlet 62 is closed while the developer D is dropping by the force of gravity.

When the amount of developer transported per unit time increases by switching to the high rotation speed, the amount of the developer ejected per unit time should increase that much. However, in the actuality, when the rotation speed changes from low to high, the opening time period per rotation is reduced, and the developer is apt to be ejected without as much amount as remains without passing through the outlet 62 when the outlet 62 is closed while the developer D is dropping by the force of gravity. This occurs each time the outlet 62 is opened.

As apparent from the above discussion, the amount of developer that remains in the ejection passage 92 is larger in high speed than in low speed, and the ratio of the amount of developer ejected per unit time to the amount of developer transported per unit time is lower in high speed than in low speed.

Accordingly, by adopting the structure of the present embodiment having the shutter 63, it is possible to restrict the amount of ejected developer D compared with the structure in which the conventional outlet is always opened when the system speed changes from low to high with the mode switching.

FIGS. 8A through 8D illustrate the amounts of ejected developer in low speed and high speed in: the structure of the present embodiment having the shutter 63 (working example); and a conventional structure in which the shutter is not provided, and the outlet of the ejection passage is always opened (comparative example).

Figure 8A:
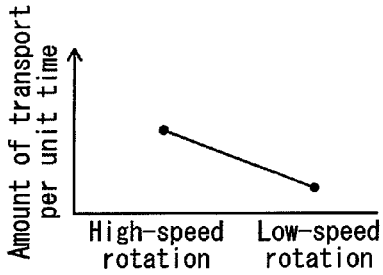
FIGS. 8A through 8D illustrate the amounts of ejected developer in low speed and high speed in the structures of the present embodiment and a comparative example.

FIG. 8A shows the relationship between the amount of developer transported by the transport screw 52 per unit time and the rotation speed of the transport screw 52. As shown in the figure, in both the working example and the comparative example, the amount of transported developer is larger when the rotation speed of the transport screw 52 is high than when it is low.

Figure 8C:
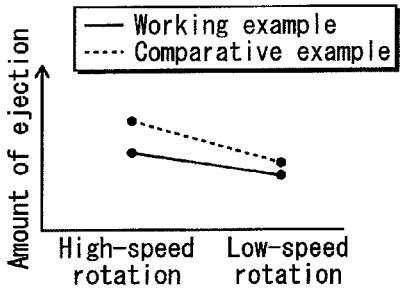
Figure 8B:
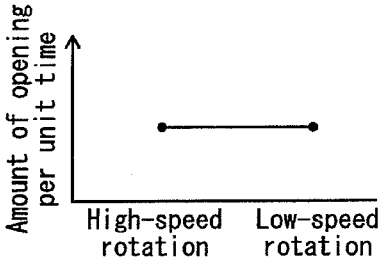

FIG. 8B shows the relationship between the amount opening of the outlet 62 per unit time and the rotation speed of the transport screw 52. In the working example, the same amount is opened regardless of whether the rotation speed of the transport screw 52 is low or high, as described above. The "amount of opening" indicates a value obtained by multiplying the number of rotations per unit time by the time required for the outlet 62 to be closed entirely again after being opened, during which the outlet 62 is gradually opened until it is entirely opened, and then is gradually closed until it is entirely closed. Note that the comparative example has the structure in which the outlet is always opened, thus the amount of opening is constant.

FIG. 8C shows the relationship between the amount of ejection of developer per unit time and the rotation speed of the transport screw 52. As shown in FIG. 8C, the difference in the amount of ejection between the working example and the comparative example is small in the low rotation speed, and large in the high rotation speed.

In the low rotation speed, even in the working example, the opening time period of the outlet 62 can be set to be long to some extent, thus the amount of ejected developer can be large to some extent, but the outlet 62 is closed for a certain time period as the shutter 63 rotates. As a result, the amount of ejected developer of the working example is less than that of the comparative example in which the outlet is always opened, but is close thereto.

In the high-speed rotation of the comparative example, the more the amount of developer transported per unit time is, the more the amount of developer ejected per unit time is. On the other hand, the working example is smaller than the comparative example in the angle of slant of the line in the graph. This is because, although the amount of transported developer increases when the rotation speed is changed from low to high, the amount of ejected developer is reduced by as much amount as remains in the ejection passage 92 due to the phenomenon that is more apt to occur in the high rotation speed than in the low rotation speed, namely, the phenomenon in which the developer remains in the ejection passage 92 without passing through the outlet 62 when the outlet 62 is closed while the developer is dropping by the force of gravity.

Figure 8D:
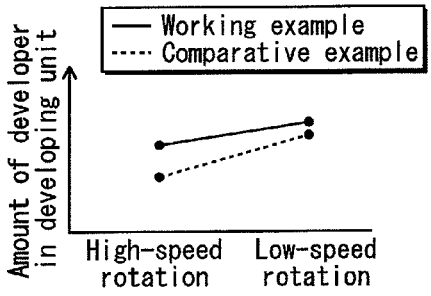

FIG. 8D shows the relationship between the amount of developer in the developing housing 50 and the rotation speed of the transport screw 52. FIG. 8D corresponds to FIG. 8C. As shown in FIG. 8D, in the high rotation speed, the working example is smaller than the comparative example in the amount of the developer D ejected per unit time, and is larger in the amount of developer in the developing housing 50 that much. That is to say, in the working example, the reduction in the amount of developer in the developing housing 50, which occurs in the comparative example, does not occur.

As understood from the relationship between the amount of ejection of developer and the rotation speed of the transport screw 52 shown in FIG. 8C, in the working example, the amount of ejection of developer is small even when the transport screw 52 is rotated at the high speed. Thus it is possible to restrict the reduction of the amount of developer in the developing housing 50 that much even if the amount of transported developer increases when the rotation speed is changed from low to high, reducing the difference from the amount of developer in the developing housing 50 in the low rotation speed, thus restricting the variation in the amount of developer.

As shown in FIG. 8C, in the comparative example, the amount of ejected developer increases when the rotation speed is changed from low to high. The amount of developer in the developing housing 50 decreases that much, the liquid surface of the developer is lowered, and the shortage of the developer supply is apt to occur. However, with adoption of the structure of the working example, it is possible to restrict the reduction of the amount of developer in the developing housing 50 and prevent the shortage of developer supply due to lowering of the liquid surface of the developer.

Also, the restriction of the variation in the amount of developer makes it possible for the amount of developer in the developing housing 50 to fall in the appropriate range for the developing, enabling an appropriate developing to be performed in either the color mode or the monochrome mode, namely, regardless of whether the rotation speed of the transport screw 52 is low or high.

<Measurement of Amount of Ejected Developer in Working and Comparative Examples>

Next, with reference to FIGS. 9 through 12, the results of the measurement of the amount of ejection of developer by conducting an experiment on the actual structures of the working and comparative examples.

Figure 9:
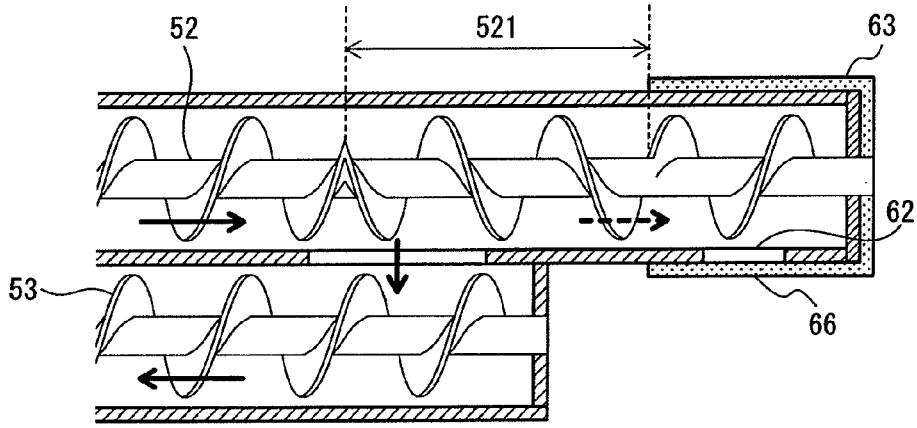
FIG. 9 is a cross sectional view of a part of the developing unit in the working example 1.

FIG. 9 shows the structure of the working example (hereinafter referred to as "working example 1"), which is the same as the structure shown in FIG. 3 except that the number of windings in the reverse winding part 521 is 2.5, different from the structure shown in FIG. 7. More specifically, each of the transport screw 52 and the stirring screw 53 has a structure where the pitch of the spiral vane is 30 [mm], the outer diameter of the spiral vane is 16 [mm], the number of rotations in the high speed is 320 [rpm], the number of rotations in the low speed is 120 [rpm], the size of each of the outlet 62 and the hole 66 is 10 [mm]×5 [mm], and the diameter of the developing roller 51 is 25 [mm].

Figure 10:
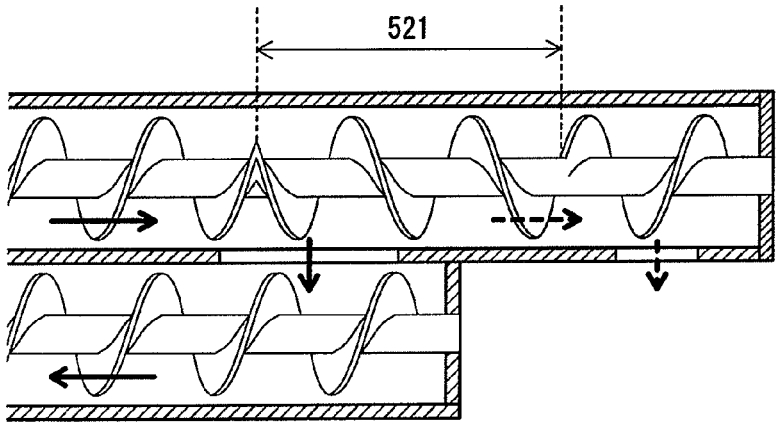
FIG. 10 is a cross sectional view of a part of the developing unit in the comparative example 1.
Figure 11:
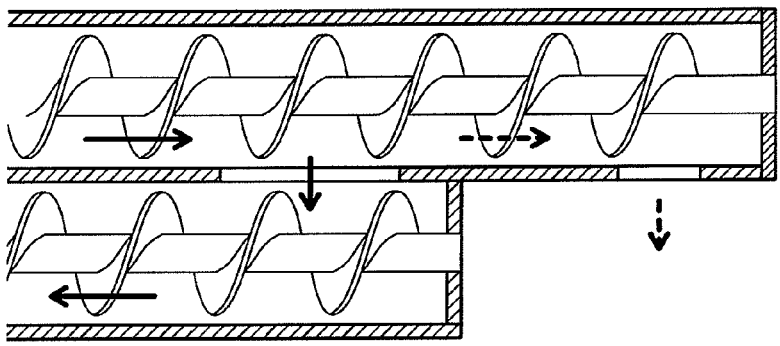
FIG. 11 is a cross sectional view of a part of the developing unit in the comparative example 2.

FIG. 10 shows the structure of comparative example 1 (the structure in which the outlet 62 is always opened) which is obtained by removing the shutter 63 from the structure of the working example 1 shown in FIG. 9. FIG. 11 shows the structure of comparative example 2 which is obtained by removing the reverse winding part 521 from the structure of the comparative example 1 shown in FIG. 10.

Note that the present experiment was conducted in the state where, in each of the working example 1 and comparative examples 1 and 2, the developing housing on the outlet 62 side (device back side) was slanted down by 3 [°] from the horizontal direction so that it is easier for the developer D to move toward the outlet 62 under the influence of the force of gravity than when the developing housing is postured to be horizontal. The reason that the experiment was conducted in the state in which the developing housing was slanted is that it was intended to check the difference in the amount of ejected developer between the working example and the comparative examples in the state in which the amount of ejected developer is apt to increase.

Figure 12:
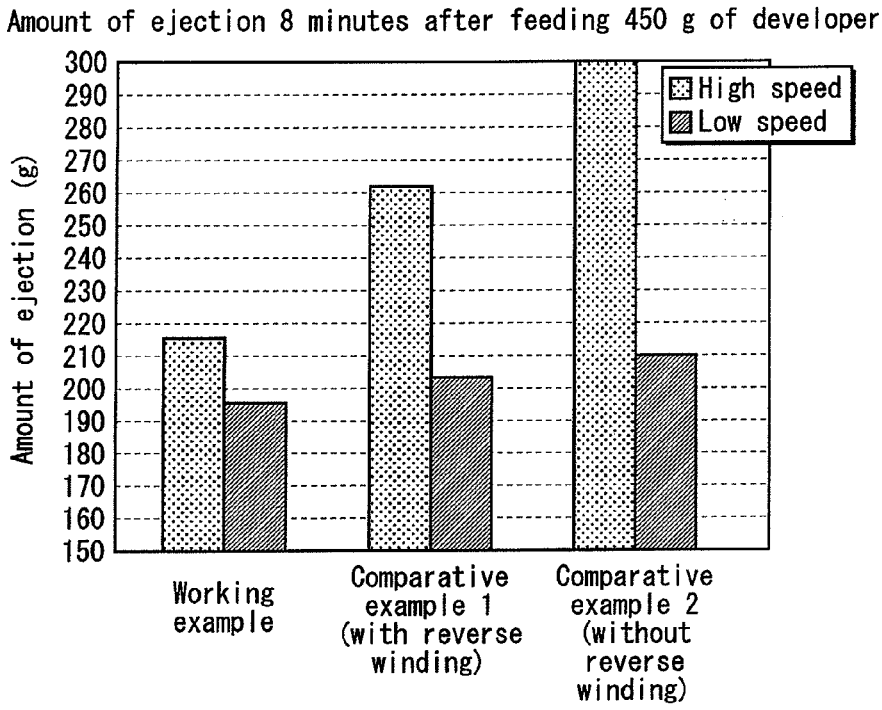
FIG. 12 shows the results of the measurement of the amount of developer for each of the working example 1 and the comparative examples 1 and 2, in each of the high rotation speed and the low rotation speed.

FIG. 12 is a graph showing the results of the measurement of the amount of developer after a predetermined time period has passed after feeding 450 [g] of developer D to each of the working example and the comparative examples, in each of the high rotation speed and the low rotation speed. In this experiment, the predetermined time period was 8 minutes. The predetermined time period corresponds to the time taken for the developer to be sufficiently distributed (to be stable) in the developing housing 50 after the developer starts to be fed and is transported cyclically in the developing housing 50.

As apparent from FIG. 12, the working example 1 was the smallest and the comparative example 2 was the largest in the amount of ejection in the low rotation speed, among the working example 1 and the comparative examples 1 and 2, although the difference among them is not so large. This is because the amount of developer D transported by the transport screw 52 per unit time is small in the low rotation speed, and thus the amount of developer fed into the ejection passage 92 from the transport passage 91 per unit time is small as well. When the amount of ejected developer in the comparative example 2 is set as the standard, the comparative example 1 is smaller than the comparative example 2 in the amount of ejected developer. This is because, since the reverse winding part 521 is provided in the comparative example 1, the comparative example 1 is smaller than the comparative example 2 in the amount of developer fed to the ejection passage 92.

In the working example 1, with the shutter 63, the outlet 62 is opened once and the developer D is ejected each time the transport screw 52 is rotated once, while in the comparative example 1, the outlet is always opened. Due to this difference, the working example 1 is smaller than the comparative example 1 in the amount of ejected developer.

On the other hand, in the high rotation speed, the difference among the working example 1 and the comparative examples 1 and 2 is very large. The difference between the comparative examples 1 and 2 in the amount of ejected developer derives from the presence of the reverse winding part 521, as in the low rotation speed. However, since the amount of developer transported per unit time is increased when the rotation speed of the transport screw 52 is changed from low to high, the amount of ejected developer increases both in the comparative examples 1 and 2. Thus the difference between the comparative examples 1 and 2 in the amount of ejected developer in the high rotation speed is larger than in the low rotation speed.

The working example 1 is far smaller than the comparative example 1 in the amount of ejected developer. Both in the working example 1 and the comparative example 1, the amount of developer transported per unit time is increased when the rotation speed of the transport screw 52 is changed from low to high. However, in the working example 1, the amount of opening of the outlet 62 is restricted by the shutter 63, and thus the working example 1 is smaller than the comparative example 1 in the amount of ejected developer.

Also, the working example 1 is far smaller than the comparative examples 1 and 2 in the difference in the amount of ejected developer between the low rotation speed and the high rotation speed. When the difference in the amount of ejected developer between the low rotation speed and the high rotation speed is small, the variation in the amount of developer housed in the developing housing 50 is restricted. This prevents the phenomenon that, although in the low rotation speed (color mode), a sufficient amount of developer can be supplied, the amount of developer is reduced and the shortage of the developer supply occurs when the rotation speed is changed from low to high (monochrome mode).

Conversely, when the rotation speed is changed from high to low, the amount of ejected developer per unit time increases, and even if the amount of developer in the developing housing 50 has been increased slightly due to the restriction of ejection of the developer during the high-speed rotation, the ejection of the developer is accelerated and the amount of developer in the developing housing 50 is apt to return to the state before the high-speed rotation is started, and the position of the liquid surface of the developer D becomes stable.

In this way, it is possible to stabilize the position of the liquid surface of the developer D even when the developing housing has been slanted so that it is easier for the developer D to move toward the outlet under the influence of the force of gravity. Of course, a similar effect can be produced when the developing housing is postured to be horizontal, not slanted to be under the influence of the force of gravity.

Note that, although the shutter 63 functions to restrict the amount of ejected developer D while the transport screw 52 rotates at a high speed, the reduction in the amount of ejected developer may increase the amount of developer D that remains in the ejection passage 92 depending on the structure of the device.

In that case, the amount of developer in the ejection passage 92, which is the sum of the amount transported from the transport passage 91 and the amount remaining in the ejection passage 92 without being ejected, gradually increases since the amount of developer D transported from the transport passage 91 has increased after the rotation speed of the transport screw 52 has been changed from low to high.

When the amount of developer in the ejection passage 92 increases excessively, the load imposed on the driving of the transport screw 52 increases, and the driving torque of the transport screw 52 increases, which imposes the load on the driving motor 18 and may cause the transport screw 52 to rotate unevenly.

Figure 13A:
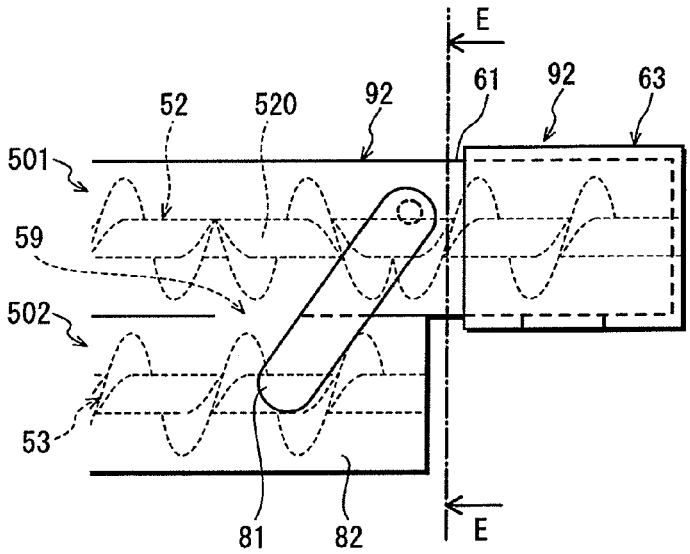
FIGS. 13A and 13B show an example of the structure in which a bypass is provided as a bypass for transporting the developer from the ejection passage to the stirring chamber.
Figure 13B:
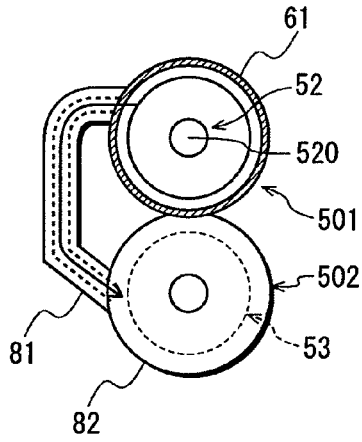

To prevent the amount of developer in the ejection passage 92 from increasing in such a manner, the structure shown in FIGS. 13A and 13B may be adopted, for example.

FIG. 13A is a side view of the structure in which a bypass 81 is provided as a bypass for transporting the developer from the ejection passage 92 to the stirring chamber 502. FIG. 13B is a cross sectional view of the structure taken along the line E-E of FIG. 13A.

As shown in FIGS. 13A and 13B, the bypass 81 is a member in a shape of a pipe. One end of the bypass 81 is connected to a part (first part) of the housing part 61 that constitutes the ejection passage 92, the first part being higher in position than the rotation shaft 520 of the transport screw 52. The other end of the bypass 81 is connected to a part (second part) of a sidewall 82 of the stirring chamber 502, the second part being in the stirring chamber 502 on the downstream of the position where the transport passage 91 diverges to the ejection passage 92 in the transport direction of the developer D. The ejection passage 92 and the stirring chamber 502 are connected with each other via the bypass 81, and the inside of the bypass 81 constitutes a passage for transporting the developer D.

When the developer D in the ejection passage 92 increases in amount, and the liquid surface of the developer D rises to pass the level of the rotation shaft 520 and reach the first part (entrance) where the bypass 81 is connected to the housing part 61, the developer D is sent from the entrance of the bypass 81 into the stirring chamber 502 via the inside of the bypass 81, as indicated by the solid-line arrow shown in FIG. 13B.

Accordingly, in the ejection passage 92, the liquid surface of the developer D does not rise above the entrance of the bypass 81. With this structure, it is possible to prevent the driving load of the transport screw 52 from increasing due to the increase in the amount of developer in the ejection passage 92, and to prevent the transport screw 52 from rotating unevenly due to the increase of the driving load.

Note that the position of the first part is not limited to the position higher than the rotation shaft 520 of the transport screw 52. For example, the first part may be positioned at the same height as the rotation shaft 520. Also, the position of the first part may be lower than the rotation shaft 520. It should be noted here however that the lower the position of the first part is, the larger the amount of developer returned from the ejection passage 92 to the transport passage 91 is. Accordingly, the position, diameter and the like of the bypass 81 are determined so that a necessary amount of developer is returned to the transport passage 91.

Modifications

Up to now, the present invention has been described specifically through embodiments. However, the present invention is not limited to the above-described embodiments, but may be modified variously as in the following.

(1) The above embodiment recites, as one example, a structure where the shutter 63 rotates in the same direction as the transport screw 52. However, the present invention is not limited to the structure. Any structure may be adopted as far as it is possible to restrict the amount of developer ejected from the outlet 62 to counterbalance against the increase of the amount of developer D transported per unit time into the ejection passage 92 when the transport screw 52 is rotated at a high speed.

Figure 14A:
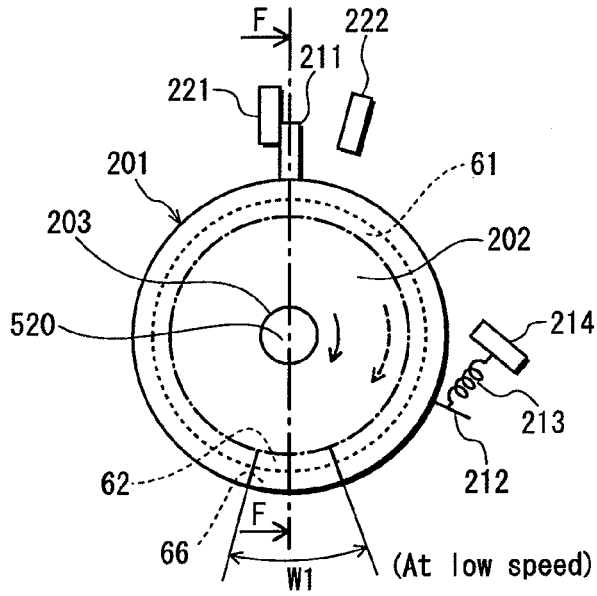
FIGS. 14A through 14C show the structure of a shutter in a modification.
Figure 14B:
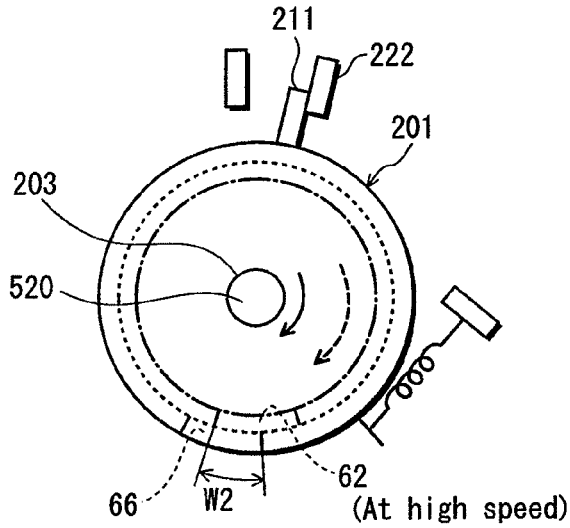
Figure 14C:
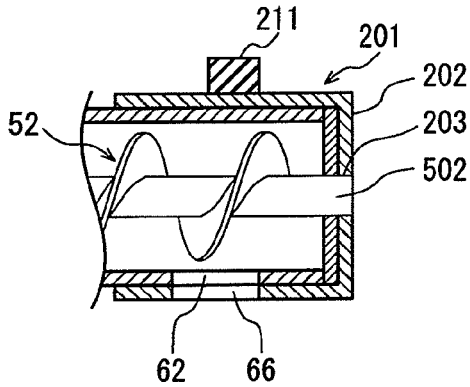

For example, the structure shown in FIGS. 14A through 14C may be adopted.

FIGS. 14A and 14B show the structure of a shutter 201 of a modification seen from the device back side. FIG. 14C is a cross sectional view of the shutter 201 taken along the line F-F of FIG. 14A.

As shown in these figures, the shutter 201 is basically the same as the shutter 63 in the above embodiment in shape, except that a hole 203 in a circular shape is provided in a bottom part 202. Note that the cross sectional shape of the end of the rotation shaft 520 of the transport screw 52 is made circular to match the circular shape of the hole 203.

The diameter of the rotation shaft 520 of the transport screw 52 is substantially the same as the diameter of the hole 203 of the bottom part 202, is fixed in the hole 203, and is supported rotatably in the state where a certain frictional force is generated with the bottom part 202.

Accordingly, when the rotation shaft 520 rotates, a force, which is a part of the rotational driving force thereof corresponding to the frictional force generated with the bottom part 202 of the shutter 201, is conveyed to the shutter 201, and the shutter 201 passively rotates.

The highest part of the circumferential surface of the shutter 201 is provided with a projection 211, and a pin 212 is provided to stand on the circumferential surface at a position between the projection 211 and the hole 66 along the circumferential direction. One end of a pull spring 213, which is one example of the urging unit, is attached to the pin 212, and the other end of the pull spring 213 is attached to a supporting unit 214 provided in the developing housing 50.

The pulling force (urging force) of the pull spring 213 is set to be slightly larger than the frictional force which is generated between the shutter 201 and the rotation shaft 520 of the transport screw 52 when the transport screw 52 rotates at the low speed.

Accordingly, as shown in FIG. 14A, when the transport screw 52 rotates at the low speed, the shutter 201 does not rotate passively following the transport screw 52, but stops in a first posture in which the projection 211 is engaged with a stopping piece 221 provided in the developing housing 50 while receiving a force in the reverse direction of the rotation direction of the rotation shaft 520 by the pulling force of the pull spring 213.

In the first posture, the position of the stopping piece 221 in the direction of rotation around the rotation shaft 520 is preliminarily adjusted so that approximately the whole of the hole 66 of the shutter 201 overlaps with the outlet 62. This makes it possible for the developer D to be ejected in the state where the opening width of the outlet 62 is W1 when the transport screw 52 rotates at the low speed.

On the other hand, as shown in FIG. 14B, the rotation speed of the transport screw 52 is changed from low to high, a larger frictional force is generated between the shutter 201 and the rotation shaft 520 of the transport screw 52 than in the low rotation speed, and the frictional force becomes larger than the pulling force of the pull spring 213.

As a result, the shutter 201 rotates passively following the transport screw 52 against the pulling force of the pull spring 213, and stops in a second posture in which the projection 211 is engaged with a stopping piece 222 provided in the developing housing 50.

In the second posture, the position of the stopping piece 222 is preliminarily adjusted so that approximately half of the hole 66 of the shutter 201 overlaps with the outlet 62 and half of the outlet 62 is covered by the shutter 201, thus the developer D is ejected in the state where the opening width of the outlet 62 is W2, which is approximately half of W1, when the transport screw 52 rotates at the high speed.

The narrower the opening width (corresponding to the opening area) of the outlet 62 is, the smaller the amount of the developer D ejected from the outlet 62 per unit time is. Accordingly, the total amount of ejected developer per rotation is smaller in the high rotation speed than in the low rotation speed. Note that when the transport screw 52 is changed from the high-speed rotation to the low-speed rotation, the shutter 201 returns to the first posture shown in FIG. 14A, and the developer D is ejected in the state where the opening width is W1.

(2) In the above embodiment, the condition for switching the rotation speed of the transport screw 52 is a switch between the color mode and the monochrome mode. However, the present invention is not limited to this. Any condition may be used as far as it causes the rotation speed of the transport screw 52 from the first speed to the second speed which is different from the first speed. For example, the condition may be the type of the paper sheet S for use.

The paper sheet falls into, for example, the following types: regular; thin; and thick. The fixing process for thin paper requires a smaller amount of heat than for regular paper. Thus, when the thin paper is used, the system speed may be controlled to be faster than when the regular paper is used. Also, the fixing process for thick paper requires a larger amount of heat than for the regular paper. Thus, when the thick paper is used, the system speed may be controlled to be slower than when the regular paper is used.

When the control for using the thick paper is performed, the following differences occur between the structure of the embodiment (working example) and a comparative example (the structure in which the outlet is always opened).

That is to say, the following shows the difference in the amount of developer in the developing housing 50 between the working example and the comparative example when the rotation speed of the transport screw 52 decreases to be under the speed for using the regular paper, while the thick paper is used, on the presumption that the amount of ejected developer is preliminarily determined so that the liquid surface of the developer in the developing housing 50 is at a predetermined level when the system speed is a standard speed.

In the case of the comparative example, as described above, the difference in the amount of ejected developer D per unit time between the low rotation speed and the high rotation speed of the transport screw 52 is large. When the rotation speed of the transport screw 52 is changed from high to low, the amount of ejected developer is reduced as much as the speed is decreased, and the amount of developer in the developing housing 50 including the ejection passage 92 is increased.

When the amount of developer in the developing housing 50 continues to increase, it may pass an excessive level. In that case, the driving loads of the developing roller 51, transport screw 52, and stirring screw 53 increase and the driving torques thereof increase, which imposes the load on the driving motor 18 and may cause the transport screw 52 to rotate unevenly, or causes the developer to be supplied excessively to the developing roller 51, making it easy for the developer D to flow over the opening 57 of the developing housing 50.

On the other hand, in the structure of the embodiment, the difference in the amount of ejected developer D per unit time between the low rotation speed and the high rotation speed of the transport screw 52 is smaller than in the comparative examples. Thus, when the rotation speed is changed from high to low, the amount of increase in the amount of developer in the developing housing 50 is restricted, compared to the comparative examples. When the amount of increase in the amount of developer is restricted, the amount of developer in the developing housing 50 is prevented from increasing contrary to the comparative examples, making it difficult for the uneven rotation of the driving motor 18 or the overflow of the developer D to occur.

In this way, with the structure of the embodiment, it is possible to realize an appropriate developing by restricting the variation in the amount of developer in the developing housing 50 regardless of whether the type of the used paper is regular or thick.

(3) In the above embodiment, the cylindrical shutter 63 is fit onto the cylindrical housing part 61. However, not limited to this, the shutter 63 may be, for example, fit into the housing part 61 as far as the shutter 63 is fit in the state where it is rotatable relative to the housing part 61.

Also, in the above embodiment, the shutter 63 has a shape of a cylinder whose one end is opened and the other end has a bottom. However, the shutter 63 may have, for example, a shape of a cylinder that does not have a bottom (both ends are opened). When the shutter 63 has such a shape, the cylindrical shutter is connected with the rotation shaft 520 of the transport screw 52 via a member other than the bottom part 65. More specifically, an end of the rotation shaft 520 may extend to outside via a hole provided at an end of the housing part 61, and the extending-out part of the rotation shaft 520 may be connected with the cylindrical shutter via a connection member having the shape of a rod or the like.

As another structure, a driving mechanism for driving the cylindrical shutter to rotate may be provided outside the shutter, and the driving mechanism may vary the rotation speed of the shutter depending on the mode.

Also, the housing part 61 and the shutter 63 are not limited to the shape of a cylinder which is the case described above. The housing part and the shutter may take any structure as far as it controls the amount of ejected developer so that a first amount of developer is ejected per rotation when the transport screw 52 rotates at a first speed, and a second amount of developer is ejected per rotation when the transport screw 52 rotates at a second speed, the second amount being smaller than the first amount, the second speed being higher than the first speed.

For example, the housing part 61 (ejection passage 92) and the shutter 63 may be formed in a shape of a cylinder whose cross-sectional shape is a polygon, and they may be fitted to each other and supported in the state where they can slide freely in axis direction. In that case, the housing part 61 and the shutter 63 may further take the following structure: the outlet 62 and the hole 66 are provided in the respective side surfaces of the housing part 61 and the shutter 63 that face each other; and the shutter 63 is moved to slide by a driving force of an actuator such as a direct-acting motor so that the developer is ejected only when the hole 66 overlaps with the outlet 62, and the outlet 62 is closed when they are not overlapping with each other.

In this structure, the shutter 63 is moved so that the outlet 62 is opened for the first time period when the transport screw 52 rotates at the first speed, and the outlet 62 is opened for the second time period when the transport screw 52 rotates at the second speed, the second time period being shorter than the first time period. The housing part 61 and the shutter 63 may be formed in a shape of a cylinder including a cylinder whose cross-sectional shape is a polygon.

As another structure, a diaphragm mechanism including a plurality of diaphragm blades may be provided at the outlet 62 of the ejection passage 92 wherein the plurality of diaphragm blades are moved to vary the amount of opening (opening area), and the positions of the plurality of diaphragm blades are controlled so that the amount of opening is a first size when the rotation speed of the transport screw 52 is the first speed, and the amount of opening is a second size when the rotation speed of the transport screw 52 is the second speed, the second size being smaller than the first size. With this structure, the mechanism for rotating the shutter is unnecessary. As further structures, the outlet 62 may double the diaphragm mechanism, and when the diaphragm mechanism is adopted, the housing part 61 may be formed in the shape of a cylinder whose cross-sectional shape is circle, polygon or the like. Each of the above structures may be applied to the structure of the modification (1) as well.

(4) In the above embodiment, the developing device and the image forming apparatus of the present invention are applied to a tandem color digital printer. However, the present invention is not limited to this structure. The present invention is applicable to a developing device of the trickle developing method and an image forming apparatus having the developing device, wherein the developing device performs, when forming either a color image or a monochrome image, an operation of replenishing a replenishment carrier to a housed two-component developer containing carrier and toner, and an operation of gradually ejecting the developer to outside from an outlet via an ejection passage that diverges from a transport passage, while transporting the developer through the transport passage by causing the transport screw provided in the transport passage to rotate, and the image forming apparatus is, for example, a copier, a facsimile apparatus, or an MFP (Multiple Function Peripheral). Also, in the above embodiment, as one example, a photosensitive drum is used as an image holder. Not limited to the photosensitive drum, the image holder may be a member in the shape of a cylinder which is hollow or solid inside, or of a belt.

Also, in the above embodiment, the transport screw 52 is provided with the reverse winding part 521 which functions to restrict the transport of the developer D especially when the transport screw 52 rotates at a high speed. However, the reverse winding part 521 may not be provided depending on the structure of the device. Furthermore, in the above embodiment, as a transport member configured to rotate to transport the developer D, the transport screw 52 provided with a spiral vane is used. Not limited to this, the transport member may be any member as far as it can rotate to transport the developer D.

Also, in the above embodiment, the transport screw 52 is provided in the developing chamber 501. However, not limited to this, the present invention, for example, can also be applied to a structure where the transport screw 52 is provided in the stirring chamber 502, and an ejection passage having an outlet is provided at one end of the stirring chamber 502. Furthermore, in the above embodiment, the developing chamber 501 is located above the stirring chamber 502. However, not limited to this structure, one of the developing chamber 501 and the stirring chamber 502 may be located obliquely above the other, or the developing chamber 501 and the stirring chamber 502 may be arranged along the horizontal plane.

Furthermore, in the above embodiment, the transport passage 91 is composed of: the straight passage 588 in the developing chamber 501; the straight passage in the stirring chamber 502; and two communication passages each connecting the respective ends of these passages on one side. However, the transport passage 91 is not limited to this structure.

Also, in the above embodiment, the ejection passage 92 extends from the transport passage 91 as a straight line. However, the ejection passage 92 is not limited to this structure. The ejection passage 92 may take any structure as far as it diverges from the transport passage 91, transports a part of the developer D that is transported in the transport passage 91, and ejects the part of the developer D to the outside.

Furthermore, in the above embodiment, one transport screw 52 is inserted in the transport passage 91 and the ejection passage 92 so as to extend through these passages to transport the developer D therethrough. Not limited to this structure, respective different screws may be provided in the transport passage 91 and the ejection passage 92 so that they rotate to transport the developer D in the respective passages.

This structure may be applied, for example, to a structure in which the ejection passage 92 diverges obliquely from the transport passage 91, not to the above structure in which the straight passage 588 of the transport passage 91 is connected with the ejection passage 92 linearly. Furthermore, no screw may be provided in the ejection passage 92 when, for example, the ejection passage 92 is short and the developer D can be transported to the outlet 62 by a transport force of the transport passage 91.

Also, in the above embodiment, the driving motor 18 is controlled to stop the rotation of the transport screw 52 in the state where the outlet 62 is closed by the shutter 63, making it possible to prevent the developer D from leaking from the outlet 62 when the user changes the image creating units. However, the present invention is not limited to this structure. For example, the control for stopping the rotation may not be performed when the device has a structure where the image creating units are not changed by the user, or a structure in which there is hardly a fear that the developer D is leaked even when the user changes the image creating units.

Furthermore, the two-component developer containing carrier and toner may consist of the carrier and the toner, or may include an additive or the like as well as the carrier and the toner.

Also, the present invention may be any combination of the above embodiment and modifications.

CONCLUSION

The above embodiment and modifications show one aspect for solving the problem explained in the "Background of the Invention" section. The above embodiment and modifications can be summarized as follows.

(1) A developing device having a housing that houses a two-component developer containing a carrier and a toner, replenishing a replenishment carrier to the housing while gradually ejecting the developer to outside from an outlet, the developing device comprising: a transport passage provided in the housing so that the developer is transported therein; a transport member provided in the housing and configured to rotate to transport the developer; an ejection passage having diverged from the transport passage so that a part of the developer transported in the transport passage is conveyed therein to the outlet; and a restriction unit configured to restrict an amount of ejected developer so that a first amount of developer is ejected from the outlet when the transport member rotates at a first speed, and a second amount of developer is ejected from the outlet when the transport member rotates at a second speed, the second amount being smaller than the first amount, the second speed being higher than the first speed.

(2) The developing device of (1), wherein the restriction unit includes: a shutter configured to move and close the outlet by covering thereof; and a moving mechanism configured to move the shutter so that the outlet is opened for a first time period per rotation of the transport member when the transport member rotates at the first speed, and the outlet is opened for a second time period per rotation of the transport member when the transport member rotates at the second speed, the second time period being shorter than the first time period.

(3) The developing device of (2), wherein the ejection passage is composed of a first cylindrical member, the outlet is provided in a circumferential surface of the first cylindrical member, the shutter is composed of a second cylindrical member whose circumferential surface has a hole, and the shutter is fixed on the first cylindrical member to be rotatable in a circumferential direction relative to the first cylindrical member, is disposed at a position where at least part of the hole overlaps with the outlet in an axis direction of the first cylindrical member, and closes the outlet when the shutter is, by rotation, at a position where the hole does not overlap with the outlet, and the moving mechanism causes the shutter to rotate in a same direction as a rotation of the transport member in coordination with the transport member.

(4) The developing device of (3), wherein the transport passage includes: a first straight passage; and a curved passage being one of two passages into which the straight passage diverges at a downstream end in a developer transport direction, the curved passage being curved relative to the first straight passage, the ejection passage includes: a second straight passage being another of the two passages and extending in a same direction as the developer transport direction of the first straight passage, wherein the transport member is inserted in the first straight passage and the second straight passage, the shutter is a cylindrical member whose one end in the axis direction is opened and another end in the axis direction has a bottom, and a portion of the shutter on a side of the opened end is fixed on the first cylindrical member, and the bottom is engaged with a rotation shaft of the transport member, and a rotational driving force of the transport member is conveyed to the shutter via the bottom thereof engaged with the rotation shaft, so that the shutter rotates in coordination with the transport member.

(5) The developing device of (1), wherein the restriction unit includes: a shutter configured to move and close the outlet by covering thereof; and a moving mechanism configured to move the shutter so that an opening area of the outlet is a first size when a rotation speed of the transport member is the first speed, and an opening area of the outlet is a second size when the rotation speed of the transport member is the second speed, the second size being smaller than the first size.

(6) The developing device of (5), wherein the shutter is supported to be rotatable around the rotation shaft of the transport member, the moving mechanism includes: a connection member connecting the shutter with the rotation shaft of the transport member, the connection member being rotatable around the rotation shaft of the transport member, and conveying a driving force in a rotation direction that is generated by a frictional force that is generated by a contact between the connection member and the rotation shaft; and an urging member configured to apply an urging force to the shutter in a reverse direction of the rotation direction of the transport member, wherein the shutter is rotated by a rotational driving force that is conveyed via the connection member when the transport member rotates, against the urging force applied by the urging member, by an angle corresponding to the rotation speed in the rotation direction.

(7) The developing device of (6), wherein the transport passage includes: a first straight passage; and a curved passage being one of two passages into which the straight passage diverges at a downstream end in a developer transport direction, the curved passage being curved relative to the first straight passage, the ejection passage includes: a second straight passage being composed of a first cylindrical member, being another of the two passages, and extending in a same direction as the developer transport direction of the first straight passage, wherein the outlet is provided in a circumferential surface of the first cylindrical member, the shutter is composed of a second cylindrical member whose circumferential surface has a hole and whose one end in the axis direction is opened and another end in the axis direction has a bottom, and a portion of the shutter on a side of the opened end is fixed on the first cylindrical member to be rotatable in a circumferential direction relative to the first cylindrical member, and is disposed at a position where at least part of the hole overlaps with the outlet in an axis direction of the first cylindrical member, and closes the outlet when the shutter is, by rotation, at a position where the hole does not overlap with the outlet, the transport member is inserted in the first straight passage and the second straight passage, the rotation shaft of the transport member is fitted in an engaging hole provided in the bottom of the shutter, and the bottom of the shutter doubles as the connection member.

(8) The developing device of (1) further comprising: a bypass connecting a first part of the ejection passage with a second part of the transport passage, the second part being on a downstream of a position where the transport passage diverges to the ejection passage in a developer transport direction, the bypass guiding the developer transported in the ejection passage from the first part of the ejection passage to the second part of the transport passage.

(9) The developing device of (8), wherein the transport passage includes: a first straight passage; and a curved passage being one of two passages into which the straight passage diverges at a downstream end in a developer transport direction, the curved passage being curved relative to the first straight passage, the ejection passage includes: a second straight passage being another of the two passages and extending in a same direction as the developer transport direction of the first straight passage, wherein the first part is connected with the second straight passage, and is higher in position than the rotation shaft of the transport member.

(10) An image forming apparatus comprising a developing device for developing an electrostatic latent image held by an image holder by using a developer, the developing device having a housing that houses a two-component developer containing a carrier and a toner, replenishing a replenishment carrier to the housing while gradually ejecting the developer to outside from an outlet, the developing device including: a transport passage provided in the housing so that the developer is transported therein; a transport member provided in the housing and configured to rotate to transport the developer; an ejection passage having diverged from the transport passage so that a part of the developer transported in the transport passage is conveyed therein to the outlet; and a restriction unit configured to restrict an amount of ejected developer so that a first amount of developer is ejected from the outlet when the transport member rotates at a first speed, and a second amount of developer is ejected from the outlet when the transport member rotates at a second speed, the second amount being smaller than the first amount, the second speed being higher than the first speed.

(11) An image forming apparatus comprising: a developing device; a driver configured to drive a transport member included in the developing device; and a controller configured to control the driver to stop the transport member from rotating, to be in a state in which an outlet of an ejection passage in the developing device is closed by a shutter provided in the developing device, wherein the developing device has a housing that houses a two-component developer containing a carrier and a toner, replenishes a replenishment carrier to the housing while gradually ejecting the developer to outside from the outlet, the developing device including: a transport passage provided in the housing so that the developer is transported therein; the transport member provided in the housing and configured to rotate to transport the developer; the ejection passage having diverged from the transport passage so that a part of the developer transported in the transport passage is conveyed therein to the outlet; and a restriction unit configured to restrict an amount of ejected developer so that a first amount of developer is ejected from the outlet when the transport member rotates at a first speed, and a second amount of developer is ejected from the outlet when the transport member rotates at a second speed, the second amount being smaller than the first amount, the second speed being higher than the first speed, wherein the restriction unit includes: a shutter configured to move and close the outlet by covering thereof; and a moving mechanism configured to move the shutter so that the outlet is opened for a first time period per rotation of the transport member when the transport member rotates at the first speed, and the outlet is opened for a second time period per rotation of the transport member when the transport member rotates at the second speed, the second time period being shorter than the first time period, wherein the ejection passage is composed of a first cylindrical member, the outlet is provided in a circumferential surface of the first cylindrical member, the shutter is composed of a second cylindrical member whose circumferential surface has a hole, and the shutter is fixed on the first cylindrical member to be rotatable in a circumferential direction relative to the first cylindrical member, is disposed at a position where at least part of the hole overlaps with the outlet in an axis direction of the first cylindrical member, and closes the outlet when the shutter is, by rotation, at a position where the hole does not overlap with the outlet, and the moving mechanism causes the shutter to rotate in a same direction as a rotation of the transport member in coordination with the transport member.

With the above-described structure, the rotation speed of the transport member is changed from the first speed to the second speed, which is faster than the first speed, the amount of ejected developer is restricted to the second amount that is smaller than the first amount which is ejected when the transport member rotates at the first speed. This prevents the deterioration of the image quality which would occur when the amount of developer is reduced due to an excessive ejection of developer which is caused by the increase in the amount of transported developer with the high-speed rotation of the transport member, and a shortage of developer supply occurs.

INDUSTRIAL APPLICABILITY

The present invention is widely applicable to developing devices and image forming apparatuses in which a two-component developer containing carrier and toner is housed based on the trickle developing method.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A developing device having comprising:

a housing that houses a two-component developer containing a carrier and a toner, wherein the developer is replenished in the housing while the developer is gradually ejected to outside from an outlet of the housing;

a transport passage provided in the housing and in which the developer is transported;

a transport member provided in the housing and configured to rotate to transport the developer;

an ejection passage which diverges from the transport passage such that a part of the developer transported in the transport passage is conveyed in the ejection passage to the outlet; and a restriction unit configured to restrict an amount of developer ejected from the outlet so that a first amount of developer is ejected per rotation of the transport member from the outlet when the transport member rotates at a first speed, and a second amount of developer is ejected per rotation of the transport member from the outlet when the transport member rotates at a second speed that is higher than the first speed, wherein the second amount of developer ejected per rotation of the transport member when the transport member rotates at the second speed is smaller than the first amount of developer ejected per rotation of the transport member when the transport member rotates at the first speed, and wherein the restriction unit comprises:

a shutter configured to move and close the outlet by covering the outlet; and a moving mechanism configured to move the shutter so that the outlet is opened for a first time period per rotation of the transport member when the transport member rotates at the first speed, and the outlet is opened for a second time period per rotation of the transport member when the transport member rotates at the second speed, the second time period being shorter than the first time period, wherein the moving mechanism moves the shutter so as to close the outlet so that developer is not ejected from the outlet during periods other than the first time period or the second time period.

2. The developing device of claim 1, wherein:

the ejection passage comprises a first cylindrical member, the outlet is provided in a circumferential surface of the first cylindrical member, the shutter comprises a second cylindrical member which has a hole provided in a circumferential surface thereof, the shutter is fixed on the first cylindrical member to be rotatable in a circumferential direction relative to the first cylindrical member, and is disposed at a position where the hole is aligned with the outlet in an axis direction of the first cylindrical member, the shutter is rotatable to a position where the hole overlaps with the outlet in a radial direction of the first cylindrical member, and to a position where the hole does not overlap with the outlet such that the shutter closes the outlet, and the moving mechanism causes the shutter to rotate in a same direction as a rotation of the transport member in coordination with the transport member.

3. The developing device of claim 2, wherein:

the transport passage includes:

a first straight passage; and a curved passage into which the first straight passage diverges at a downstream end in a developer transport direction, the curved passage being curved relative to the first straight passage, the ejection passage includes a second straight passage into which the first straight passage of the transport passage diverges and which extends in a same direction as the developer transport direction of the first straight passage, the transport member is inserted in the first straight passage and the second straight passage, the second cylindrical member of the shutter has one axial end which is open and another axial end which has a bottom, and a portion of the shutter on a side of the open end is fixed on the first cylindrical member, and the bottom of the shutter is engaged with a rotation shaft of the transport member, and a rotational driving force of the transport member is conveyed to the shutter via the bottom thereof which is engaged with the rotation shaft, so that the shutter rotates in coordination with the transport member.

4. The developing device of claim 1, further comprising:

a bypass which connects a first part of the ejection passage with a second part of the transport passage, the second part being downstream of a position where the transport passage diverges into the ejection passage in a developer transport direction, the bypass guiding the developer transported in the ejection passage from the first part of the ejection passage to the second part of the transport passage.

5. The developing device of claim 4, wherein:

the transport passage includes:

a first straight passage; and a curved passage into which the first straight passage diverges at a downstream end in a developer transport direction, the curved passage being curved relative to the first straight passage, the ejection passage includes a second straight passage into which the first straight passage of the transport passage diverges and which extends in a same direction as the developer transport direction of the first straight passage, and the first part of the ejection passage, to which the bypass is connected, is connected with the second straight passage, and is higher in position than the rotation shaft of the transport member.

6. An image forming apparatus comprising:

the developing device according to claim 1.

7. A developing device comprising:

a housing that houses a two-component developer containing a carrier and a toner, wherein the developer is replenished in the housing while the developer is gradually ejected to outside from an outlet of the housing;

a transport passage provided in the housing and in which the developer is transported;

a transport member provided in the housing and configured to rotate to transport the developer;

an ejection passage which diverges from the transport passage such that a part of the developer transported in the transport passage is conveyed in the ejection passage to the outlet; and a restriction unit configured to restrict an amount of developer ejected from the outlet so that a first amount of developer is ejected per rotation of the transport member from the outlet when the transport member rotates at a first speed, and a second amount of developer is ejected per rotation of the transport member from the outlet when the transport member rotates at a second speed that is higher than the first speed, wherein the second amount of developer ejected per rotation of the transport member when the transport member rotates at the second speed is smaller than the first amount of developer ejected per rotation of the transport member when the transport member rotates at the first speed, wherein:

the restriction unit includes:

a shutter configured to move and cover the outlet; and a moving mechanism configured to move the shutter so that an opening area of the outlet is a first size when a rotation speed of the transport member is the first speed, and an opening area of the outlet is a second size when the rotation speed of the transport member is the second speed, the second size being smaller than the first size, the ejection passage comprises a first cylindrical member, and the outlet is provided in a circumferential surface of the first cylindrical member, the shutter comprises a second cylindrical member which has a hole provided in a circumferential surface thereof and which has one axial end which is open and another axial end which has a bottom, and the shutter is fixed on the first cylindrical member at a side of the open end thereof so as to be rotatable in a circumferential direction relative to the first cylindrical member.

8. The developing device of claim 7, wherein:

the shutter is supported to be rotatable around a rotation shaft of the transport member, the moving mechanism includes:

a connection member which connects the shutter with the rotation shaft of the transport member, the connection member being rotatable around the rotation shaft of the transport member, and conveying a driving force in a rotation direction that is generated by a frictional force that is generated by a contact between the connection member and the rotation shaft; and an urging member configured to apply an urging force to the shutter in a reverse direction of the rotation direction of the transport member, and the shutter is rotated by a rotational driving force that is conveyed via the connection member when the transport member rotates, against the urging force applied by the urging member, by an angle corresponding to the rotation speed in the rotation direction.

9. The developing device of claim 8, wherein:

the transport passage includes:

a first straight passage; and a curved passage into which the first straight passage diverges at a downstream end in a developer transport direction, the curved passage being curved relative to the first straight passage, the ejection passage includes a second straight passage a into which the first straight passage of the transport passage diverges, the second straight passage comprising the first cylindrical member, and extending in a same direction as the developer transport direction of the first straight passage, the shutter is disposed at a position where the hole is aligned with the outlet in an axis direction of the first cylindrical member, the shutter is rotatable to a position where the hole overlaps with the outlet in a radial direction of the first cylindrical member such that the opening area of the outlet is the first size when the rotation speed of the transport member is the first speed, and to a position where the hole overlaps with the outlet in the radial direction of the first cylindrical member such that the opening area of the outlet is the second size when the rotation speed of the transport member is the second speed, the transport member is inserted in the first straight passage and the second straight passage, the rotation shaft of the transport member is fitted in an engaging hole provided in the bottom of the shutter, and the connection member comprises the bottom of the shutter.

10. An image forming apparatus comprising:

a developing device;

a driver configured to drive a transport member included in the developing device; and a controller configured to control the driver to stop the transport member from rotating, to be in a state in which an outlet of an ejection passage in the developing device is closed by a shutter provided in the developing device, wherein the developing device comprises:

a housing that houses a two-component developer containing a carrier and a toner, wherein the developer is replenished in the housing while the developer is gradually ejected to outside from the outlet;

a transport passage provided in the housing so that the developer is transported therein;

the transport member, wherein the transport member is provided in the housing and configured to rotate to transport the developer;

the ejection passage, wherein the ejection passage diverges from the transport passage so that a part of the developer transported in the transport passage is conveyed through the ejection passage to the outlet; and a restriction unit configured to restrict an amount of developer ejected from the ejection passage so that a first amount of developer is ejected per rotation of the transport member from the outlet when the transport member rotates at a first speed, and a second amount of developer is ejected per rotation of the transport member from the outlet when the transport member rotates at a second speed that is higher than the first speed, wherein the second amount of developer ejected per rotation of the transport member when the transport member rotates at the second speed is smaller than the first amount of developer ejected per rotation of the transport member when the transport member rotates at the first speed, wherein the restriction unit includes:

a shutter configured to move and close the outlet by covering the outlet; and a moving mechanism configured to move the shutter so that the outlet is opened for a first time period per rotation of the transport member when the transport member rotates at the first speed, and the outlet is opened for a second time period per rotation of the transport member when the transport member rotates at the second speed, the second time period being shorter than the first time period, and wherein:

the ejection passage comprises a first cylindrical member, the outlet is provided in a circumferential surface of the first cylindrical member, the shutter comprises a second cylindrical member having a hole provided in a circumferential surface thereof, and the shutter is fixed on the first cylindrical member to be rotatable in a circumferential direction relative to the first cylindrical member, and is disposed at a position where the hole is aligned with the outlet in an axis direction of the first cylindrical member, the shutter is rotatable to a position where the hole overlaps with the outlet in a radial direction of the first cylindrical member, and to a position where the hole does not overlap with the outlet such that the shutter closes the outlet, and the moving mechanism causes the shutter to rotate in a same direction as a rotation of the transport member in coordination with the transport member.

* * * * *